United States Patent [19]

Weber

[11] Patent Number: 4,467,405

[45] Date of Patent: Aug. 21, 1984

[54] SPRING CLIP BRACKET

[75] Inventor: Franz K. Weber, Canoga Park, Calif.

[73] Assignee: Modulite Corporation, Canoga Park, Calif.

[21] Appl. No.: 481,627

[22] Filed: Apr. 4, 1983

[51] Int. Cl.[3] ..... F21V 1/06

[52] U.S. Cl. ..... 362/352; 362/355; 362/360; 362/361; 362/450

[58] Field of Search ..... 362/352, 355, 360, 361, 362/450

[56] References Cited

U.S. PATENT DOCUMENTS

| | | | |
|---|---|---|---|
| 3,689,762 | 9/1972 | Shatan | 362/352 |
| 4,086,738 | 5/1978 | Saccoccio | 362/352 |
| 4,165,529 | 8/1979 | Hagelthorn | 362/352 |
| 4,233,656 | 11/1980 | Shemitz | 362/352 |
| 4,295,187 | 10/1981 | Shemitz | 362/352 |

*Primary Examiner*—Stephen J. Lechert, Jr.
*Attorney, Agent, or Firm*—Gene W. Arant; Paul H. Ware

[57] ABSTRACT

Apparatus for use in the assembly of a lighting fixture. A retaining spring clip bracket serves as releasable locking support and positioning constraint for elongated arcuate lamp shade panels peripherally encased in a plastic molding, and usually of transparent or translucent material. Brackets may be removed so as to remove the panels for transport, cleaning or for other purposes. Panles are suspended from a panel supporting structure. The structural spring means of the spring clip bracket releasably grasps the plastic molding covered edges so as to hold parts together by the frictional forces resulting from the spring tension in the retaining spring clip bracket in contact with the plastic covered edges of the panels.

4 Claims, 8 Drawing Figures

Fig. 3.
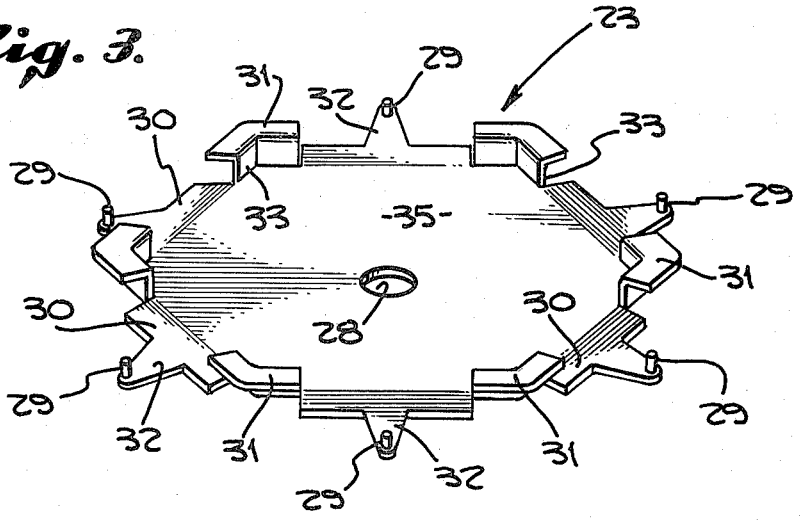
Fig. 4.
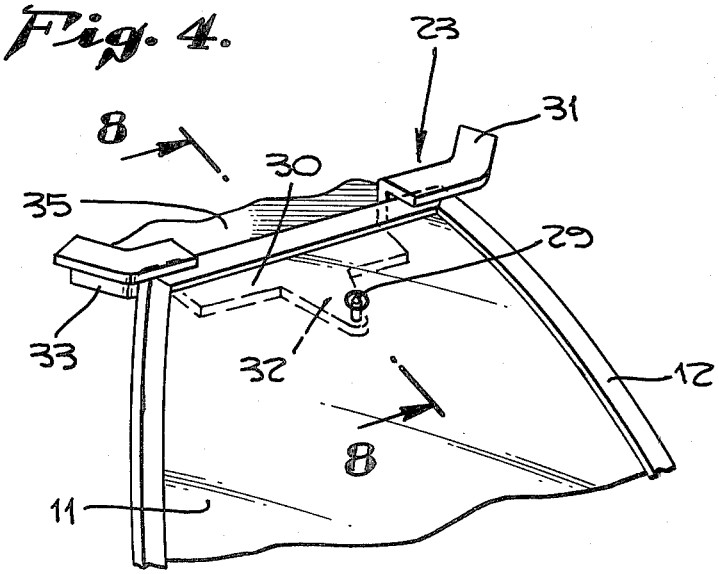
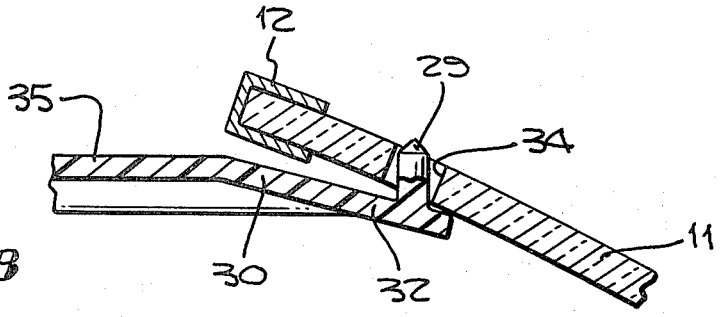
Fig. 8

SPRING CLIP BRACKET

BACKGROUND OF THE INVENTION

Conventionally lamp shades have not been made with disassembly in mind, either for transport or for other purposes and, therefore, they have usually been shipped as one-piece items. Even in those rare instances in which the lamp shade has comprised sub-assemblies, final assembly has required the use of tools in the accomplishment thereof. In general the cost of final assembly has been significant for the manufacturer or the effort has been a consideration for the ultimate consumer. Shipping costs have been high because of the larger size of containers required to ship fully assembled lamp shades. Final assembly by the ultimate consumer has been the ocassion of breakage of parts and resultant dissatisfaction with the product.

SUMMARY

The present invention contemplates a releasable retaining spring clip bracket utilized to hold panels of a lamp shade firmly together but easily removable without use of any tools so that the lamp shade panels may be assembled and disassembled repeatedly for purposes of cleaning, shipping or for any other purpose.

According to the invention, an elongated retaining spring clip bracket has two sections each of a generally flat bottommed configuration of U-shaped cross-sections that are joined by the continuous bottom of the bracket. The bracket may have an obtuse bend tending to tilt each U-shaped section away from the other at or near its latitudinal line of symmetry. On either side of said obtuse bend, near said line of latitudinal symmetry, positioning tabs may be fabricated by stamping so as to leave a kerf or slit in the flat bottom of said bracket thus making a bent-up portion or tab. The bracket, so formed, may be applied to contiguous plastic encased bottom edges of removable lamp shade panels so as to hold them firmly in place in cooperation with other assembly elements to be described.

DRAWING SUMMARY

FIG. 3 shows details of a panel supporting structure.

FIG. 4 is a drawing of details of assembly of arcuate elongated lamp shade panel members to the panel supporting structure.

FIG. 8 is a fragmentary cross-section taken along sight-lines 8—8 of FIG. 4 showing lamp shade panels as retained by the panel supporting structure.

DETAILED DESCRIPTION

Figure 1:
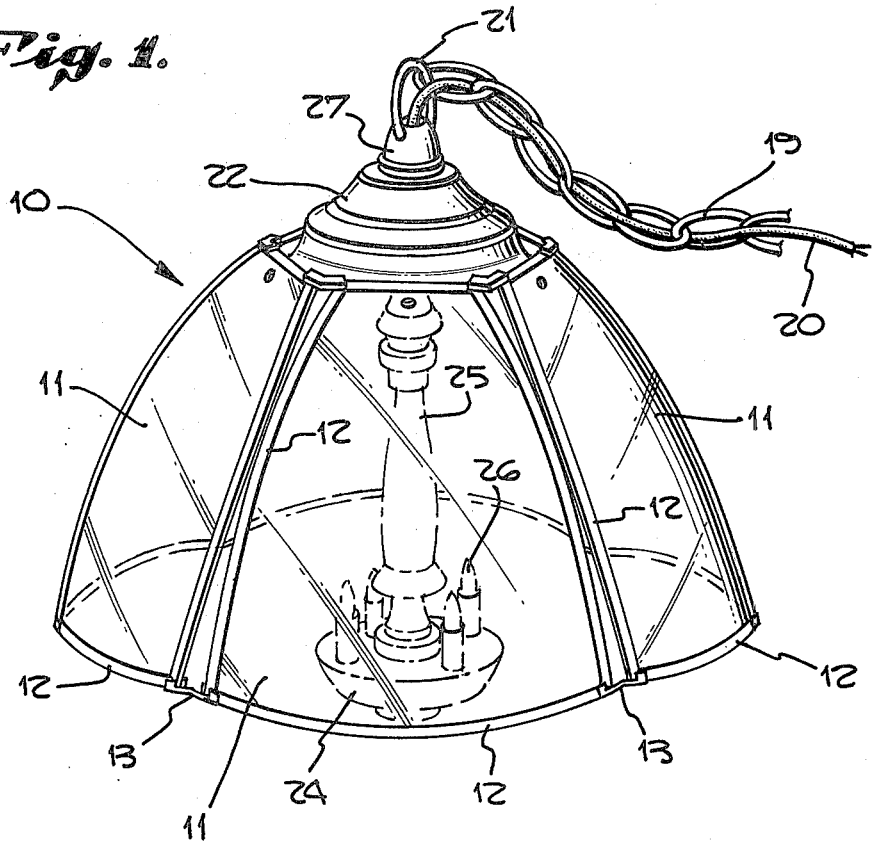
FIG. 1 is a perspective illustration of a fully assembled lighting fixture as contemplated by the invention.
Figure 2:
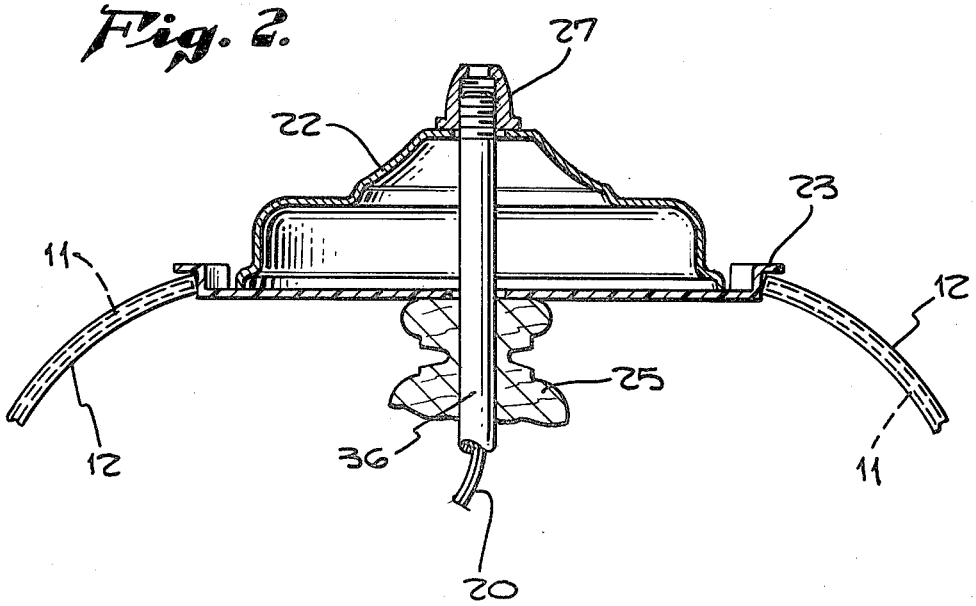
FIG. 2 is a partial cross-sectional view of details of the fixture.

Referring to FIGS. 1 and 2 with greater particularity, there is shown a completely assembled lighting fixture as contemplated by the invention and denoted generally by the numeral 10. A lamp socket assembly 24 upon which are supported lamps 26 is generally supported by support member 25. Threaded tube 36 passes through this assembly and also through vase cap 22 and is secured by securing nut 27. Securing nut 27 has attached thereto chain anchor loop 21 which forms the first link in chain 19 which supports the total structure. Electric lamp cord 20 is threaded through chain 19 and threaded tube 36 in conventional manner. Arcuate elongated lamp shade panels 11 whose peripheries are encased in plastic molding 12 are attached to the assembly by means of retaining spring clip brackets 13 and panel supporting structure 23.

Referring now to FIG. 3, panel supporting structure 23 has a primary flat structural member 35 which is provided with an aperture 28 through which threaded tube 36 may pass. Panel supporting structure 23 also comprises a plurality of shelves 30 each having a projection 32 which has at its extremity a pin 29. Counter-support shelves 31 having vertical offsets 33 are located on either side of shelves 30. In the specific supporting structure as illustrated in FIG. 3, there are six pins with associated shelf and counter-support shelf members shown. The number of elements as shown is not intended to limit the invention but is merely illustrative of a design choice.

Reference to FIGS. 4 and 8 provides insight as to the relative placement of panel supporting structure 23 with respect to arcuate elongated panels 11. In FIG. 4 the panel 11 with the plastic molding 12 in place is shown as inserted above projection 32 of shelf 30 with pin 29 about to be inserted in aperture 34 in panel 11. The insertion of pin 29 into aperture 34 may be seen more clearly in FIG. 8. There is shown also the relationship of projection 32 with respect to shelf 30 of primary flat structural member 35. FIG. 4 shows clearly the bearing of arcuate elongated panel 11 against the underside of counter-support shelf 31 as offset from shelf 30 by vertical offset member 33. Thus projection 32 containing pin 29 will anchor panel 11 in place upon shelf 30 and at the same time counter-support shelf 31 will maintain the position of panel 11 against the force of gravity.

Figure 5:
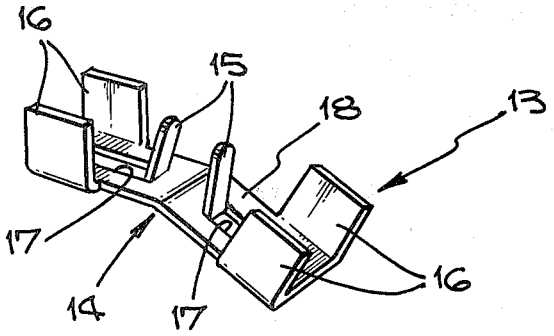
FIG. 5 is a perspective illustration showing details of the retaining spring clip bracket.

Referring now to FIG. 5, retaining spring clip bracket 13 may be explained in detail. Spring clip bracket 13 may have an obtuse bend at its latitudinal line of symmetry denoted by the numeral 14. A bottom portion or trough 18 may then be defined by bent-up members 16. Positioning tabs 15 may be fabricated by stamping out a kerf or slit 17 from the bottom portion or trough 18.

Figure 6:
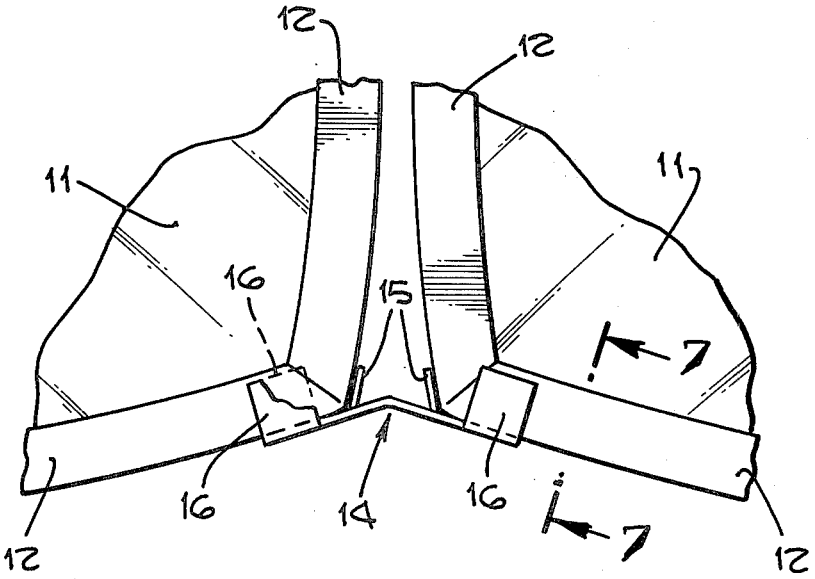
FIG. 6 is an enlarged detailed drawing showing how arcuate elongated lamp shade panels are retained and constrained by the retaining spring clip bracket.
Figure 7:
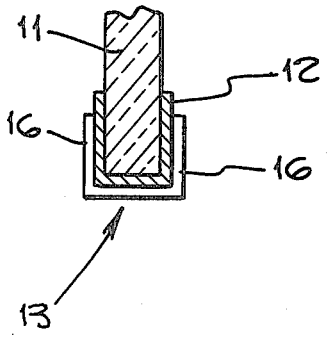
FIG. 7 is a fragmentary cross-section taken along sight-lines 7—7 of FIG. 6 showing relations of an elongated lamp shade panel, plastic molding and retaining spring clip bracket.

Reference to FIGS. 6 and 7 shows how spring clip brackets 13 constrain and retain arcuate panel members 11. The bottom portions of two arcuate panel members 11 are shown with plastic molding borders in place and spring clip bracket 13 frictionally retaining said panel members by means of bent-up members 16 and positioning tabs 15. The cross-section of FIG. 7 shows the relationship of the arcuate panels 11, plastic molding 12 and the bent-up members 16 in this assembly. It should be clear that the constraints imposed upon the panel members 11 by means of panel supporting structure 23 in preventing any downward movement of panels 11 are now complemented by the frictional constraints imposed by spring clip bracket 13 in preventing any lateral movement of the arcuate elongated lamp shade panels 11.

Assembly or disassembly of the lighting fixture may be performed with the fixture hanging from the ceiling as is common as follows: panel supporting structure 23 is secured in place by support member 25 and securing nut 27. In assembling the panels 11 to this supporting structure 23 a first panel would be positioned over shelf 30 and pin 29 of panel supporting structure 23 so that the pin 29 is in position for insertion into aperture 34 in the panel 11. Since panel 11 has been inserted over shelf 30 and under counter-support shelf 31, it will be supported there against the pull of gravity. Another panel 11 may now be assembled to a contiguous shelf 30 in the same manner as the first panel was assembled and, after such assembly, a retaining spring clip bracket 13 may be applied to the edges of the two adjacent panels as shown in FIG. 6. This method of assembly would be carried out for successive panels for adjacent pin and shelf positions on panel supporting structure 23 until all pins 29 have been used and all adjacent panel members have been fitted with retaining spring clip brackets 13. It should be clear now that all panel members are prevented from downward movement by the action of shelf 30 in conjunction with pins 29 and counter-support shelves 31. Lateral movement of the arcuate elongated lamp shade panels 11 is prevented by the constraining action of retaining spring clip brackets 13.

Thus there has been described a retaining spring clip bracket used in conjunction with a panel supporting structure and arcuate elongated lamp shade panel members in the assembly of a lighting fixture. Great improvements in reliability, maintainability, ease of cleaning, ease of assembly and disassembly and shipping advantages have been provided through the novel advantages of the invention.

It is pointed out that although the present invention has been shown and described with reference to a particular embodiment, nevertheless, various changes and modifications, obvious to one skilled in the art to which the invention pertains are deemed to lie within the purview of the invention.

What is claimed and desired to be secured by Letters Patent of the United States is:

1. A light fixture for assembly without use of tools other than the hands of the assembler, comprising:

a panel supporting structure;

a plurality of arcuate elongated lamp shade panels each having top, bottom, right-hand and left-hand portions and each being attachable by its top portion about said panel supporting structure so as to form a continuous contiguous array of said panels;

a plastic molding around the periphery of each of said arcuate elongated lamp shade panels so as to form a complete plastic casing about the edges thereof;

a plurality of retaining spring clip brackets releasably attachable to said lamp shade panels at the bottom portions thereof upon said plastic casings so as to secure by friction, contiguous right-hand and left-hand portions of adjacent panels.

2. The light fixture of claim 1 wherein said panel supporting structure comprises:

a primary flat structural member having an aperture near its center;

a plurality of shelves arranged about the periphery of said flat structural member, each shelf terminating in a projection with a pin at the distal extremity thereof;

a vertical offset member adjacent each said shelf and having a counter support shelf in turn adjacent each vertical offset member so that said shelves and said counter support shelves have alternate positions about the periphery of said flat structural member.

3. The light fixture of claim 2 wherein each of said plurality of retaining spring clip brackets comprises:

two sections each of a generally flat-bottommed configuration of U-shaped cross-section having bent up members;

a continuous bottom of said retaining spring clip bracket that joins said two sections;

an obtuse bend near the latitudinal line of symmetry between said two sections tending to tilt said two sections away from each other; and at least one positioning tab formed from said continuous bottom.

4. A method of assembling a light fixture comprising the steps of:

selecting a panel supporting structure;

applying a plastic molding about the periphery of a first arcuate elongated lamp shade panel to be attached to said supporting structure;

attaching said first arcuate elongated lamp shade panel to said panel supporting structure;

repeating the operation of applying a plastic molding about the periphery of a second arcuate elongated lamp shade panel;

attaching said second arcuate elongated lamp shade panel to said panel supporting structure adjacent said first arcuate elongated lamp shade panel;

attaching a retaining spring clip bracket to adjacent edges of said first and second arcuate elongated lamp shade panels;

repeating the above steps until the full capacity of said panel supporting structure to accept attachment of said arcuate elongated lamp shade panels has been realized.

* * * * *